US011265648B2

(12) United States Patent
Lesso

(10) Patent No.: US 11,265,648 B2
(45) Date of Patent: Mar. 1, 2022

(54) AUDIO CIRCUITRY

(71) Applicant: Cirrus Logic International Semiconductor Ltd., Edinburgh (GB)

(72) Inventor: John Paul Lesso, Edinburgh (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 17/021,156

(22) Filed: Sep. 15, 2020

(65) Prior Publication Data

US 2021/0051399 A1 Feb. 18, 2021

Related U.S. Application Data

(63) Continuation of application No. 16/668,535, filed on Oct. 30, 2019, now Pat. No. 10,820,096, which is a continuation of application No. 16/046,020, filed on Jul. 26, 2018, now Pat. No. 10,506,336.

(51) Int. Cl.
*H04R 3/00* (2006.01)
*H04R 29/00* (2006.01)

(52) U.S. Cl.
CPC ..... *H04R 3/00* (2013.01); *H04R 29/001* (2013.01); *H04R 2400/01* (2013.01)

(58) Field of Classification Search
CPC ..... H04R 3/00; H04R 29/001; H04R 29/003; H04R 3/04; H04R 3/02; H04R 3/005; H04R 27/00; H04R 2499/11; H04R 2400/01; H04R 1/1041; H04W 52/0251; H04W 52/0254
See application file for complete search history.

(56) References Cited

U.S. PATENT DOCUMENTS

2003/0118201 A1* 6/2003 Leske ..... H04R 3/00 381/117
2009/0003613 A1 1/2009 Christensen
2012/0002819 A1 1/2012 Thormundsson et al.
2014/0270312 A1* 9/2014 Melanson ..... H04R 3/005 381/365
2015/0372650 A1 12/2015 Thormundsson et al.
2017/0085233 A1 3/2017 Berkhout et al.
2018/0136899 A1 5/2018 Risberg et al.

FOREIGN PATENT DOCUMENTS

GB 2554486 A 4/2018

OTHER PUBLICATIONS

International Search Report and Written Opinion of the International Searching Authority, International Application No. PCT/GB2019/051952, dated Oct. 11, 2019.
First Office Action, China National Intellectual Property Administration, Application No. 2019800475800, dated Sep. 14, 2021.
Preliminary Rejection, Korean Intellectual Property Office, Application No. 10-2021-7001118, dated Dec. 24, 2021.

* cited by examiner

*Primary Examiner* — Yogeshkumar Patel
(74) *Attorney, Agent, or Firm* — Jackson Walker L.L.P.

(57) ABSTRACT

Audio circuitry, comprising: a speaker driver operable to drive a speaker based on a speaker signal; a current monitoring unit operable to monitor a speaker current flowing through the speaker and generate a monitor signal indicative of that current; and a microphone signal generator operable, when external sound is incident on the speaker, to generate a microphone signal representative of the external sound based on the monitor signal and the speaker signal.

18 Claims, 7 Drawing Sheets

AUDIO CIRCUITRY

This application is a continuation of U.S. patent application Ser. No. 16/668535, filed Oct. 30, 2019, which is a continuation of U.S. patent application Ser. No. 16/046020, filed Jul. 26, 2018, issued Dec. 10, 2019 as U.S. Pat. No. 10,506,336, each of which is incorporated by reference herein in its entirety.

FIELD OF DISCLOSURE

The present disclosure relates in general to audio circuitry, in particular for use in a host device. More particularly, the disclosure relates to the use of a speaker as a microphone.

BACKGROUND

Audio circuitry may be implemented (at least partly on ICs) within a host device, which may be considered an electrical or electronic device and may be a mobile device. Examples devices include a portable and/or battery powered host device such as a mobile telephone, an audio player, a video player, a PDA, a mobile computing platform such as a laptop computer or tablet and/or a games device.

Battery life in host devices is often a key design constraint. Accordingly, host devices are capable of being placed in a low-power state or "sleep mode." In this low-power state, generally only minimal circuitry is active, such minimal circuitry including components necessary to sense a stimulus for activating higher-power modes of operation. In some cases, one of the components remaining active is a capacitive microphone, in order to sense for voice activation commands for activating a higher-power state. Such microphones (along with supporting amplifier circuitry and bias electronics) may however consume significant amounts of power, thus reducing e.g. battery life of host devices.

It is known to use a speaker (e.g. a loudspeaker) as a microphone, which may enable a reduction in the number of components provided in a host device or the number of them kept active in the low-power state. Reference in this respect may be made to US9008344, which relates to systems for using a speaker as a microphone in a mobile device. However, such systems are considered to be open to improvement when both power performance and audio performance are taken into account.

It is desirable to provide improved audio circuitry, in which both power performance and audio performance reach acceptable levels. It is desirable to provide improved audio circuitry to enable a speaker (e.g. a loudspeaker) to be used both as a speaker and a microphone (e.g. simultaneously), with improved performance.

SUMMARY

According to a first aspect of the present disclosure, there is provided audio circuitry, comprising: a speaker driver operable to drive a speaker based on a speaker signal; a current monitoring unit operable to monitor a speaker current flowing through the speaker and generate a monitor signal indicative of that current; and a microphone signal generator operable, when external sound is incident on the speaker, to generate a microphone signal representative of the external sound based on the monitor signal and the speaker signal.

The speaker current may contain a speaker component resulting from the speaker signal and a microphone component resulting from the external sound incident on the speaker, with the components being substantial or negligible depending on the speaker signal and the external sound. Those components of the speaker signal will be representative of any intended emitted sound or any incoming external sound to a good degree of accuracy. This enables the microphone signal to be representative of the external sound also to a good degree of accuracy, leading to enhanced performance.

The microphone signal generator may comprise a converter configured to convert the monitor signal into the microphone signal based on the speaker signal, the converter defined at least in part by a transfer function modelling at least the speaker. The converter may be referred to as a filter, or signal processing unit.

The transfer function may further model at least one of the speaker driver and the current monitoring unit, or both of the speaker driver and the current monitoring unit. The transfer function may model the speaker alone.

The speaker driver may be operable, when the speaker signal is an emit speaker signal, to drive the speaker so that it emits a corresponding sound signal. In such a case, when the external sound is incident on the speaker whilst the speaker signal is an emit speaker signal, the monitor signal may comprise a speaker component resulting from the speaker signal and a microphone component resulting from the external sound. The converter may be defined such that, when the external sound is incident on the speaker whilst the speaker signal is an emit speaker signal, it filters out the speaker component and/or equalises and/or isolates the microphone component when converting the monitor signal into the microphone signal.

The speaker driver may be operable, when the speaker signal is a non-emit speaker signal, to drive the speaker so that it substantially does not emit a sound signal. In such a case, when the external sound is incident on the speaker whilst the speaker signal is a non-emit speaker signal, the monitor signal may comprise a microphone component resulting from the external sound. The converter may be defined such that, when the external sound is incident on the speaker whilst the speaker signal is a non-emit speaker signal, it equalises and/or isolates the microphone component when converting the monitor signal into the microphone signal.

The microphone signal generator may be configured to determine or update the transfer function or parameters of the transfer function based on the monitor signal and the speaker signal when the speaker signal is an emit speaker signal which drives the speaker so that it emits a corresponding sound signal. The microphone signal generator may be configured to determine or update the transfer function or parameters of the transfer function based on the microphone signal. The microphone signal generator may be configured to redefine the converter as the transfer function or parameters of the transfer function change. That is, the converter may be referred to as an adaptive filter.

The converter may be configured to perform conversion so that the microphone signal is output as a sound pressure level signal. The converter may be configured to perform conversion so that the microphone signal is output as another type of audio signal. Such conversion may comprise scaling and/or frequency equalisation.

The transfer function and/or the converter may be defined at least in part by Thiele-Small parameters.

The speaker signal may be indicative of or related to or proportional to a voltage signal applied to the speaker. The monitor signal may be related to or proportional to the speaker current flowing through the speaker. The speaker driver may be operable to control the voltage signal applied to the speaker so as to maintain or tend to maintain a given relationship between the speaker signal and the voltage signal. For example, the speaker driver may be configured to supply current to the speaker as required to maintain or tend to maintain a given relationship between the speaker signal and the voltage signal.

The current monitoring unit may comprise an impedance connected such that said speaker current flows through the impedance, wherein the monitor signal is generated based on a voltage across the impedance. The impedance may be or comprise a resistor.

The current monitoring unit may comprise a current-mirror arrangement of transistors connected to mirror said speaker current to generate a mirror current, wherein the monitor signal is generated based on the mirror current.

The audio circuitry may comprise the speaker, or may be provided for connection to the speaker.

The audio circuitry may comprise a speaker-signal generator operable to generate the speaker signal and/or a microphone-signal analyser operable to analyse the microphone signal.

According to a second aspect of the present disclosure, there is provided an audio processing system, comprising: the audio circuitry according to the aforementioned first aspect of the present disclosure; and a processor configured to process the microphone signal.

The processor may be configured to transition from a low-power state to a higher-power state based on the microphone signal. The processor may be configured to compare the microphone signal to at least one environment signature (e.g. a template), and to analyse an environment in which the speaker was or is being operated based on the comparison.

According to a third aspect of the present disclosure, there is provided a host device, comprising the audio circuitry according to the aforementioned first aspect of the present disclosure or the audio processing system according to the aforementioned second aspect of the present disclosure.

BRIEF DESCRIPTION OF THE DRAWINGS

Reference will now be made, by way of example only, to the accompanying drawings, of which.

DETAILED DESCRIPTION

Figure 1:
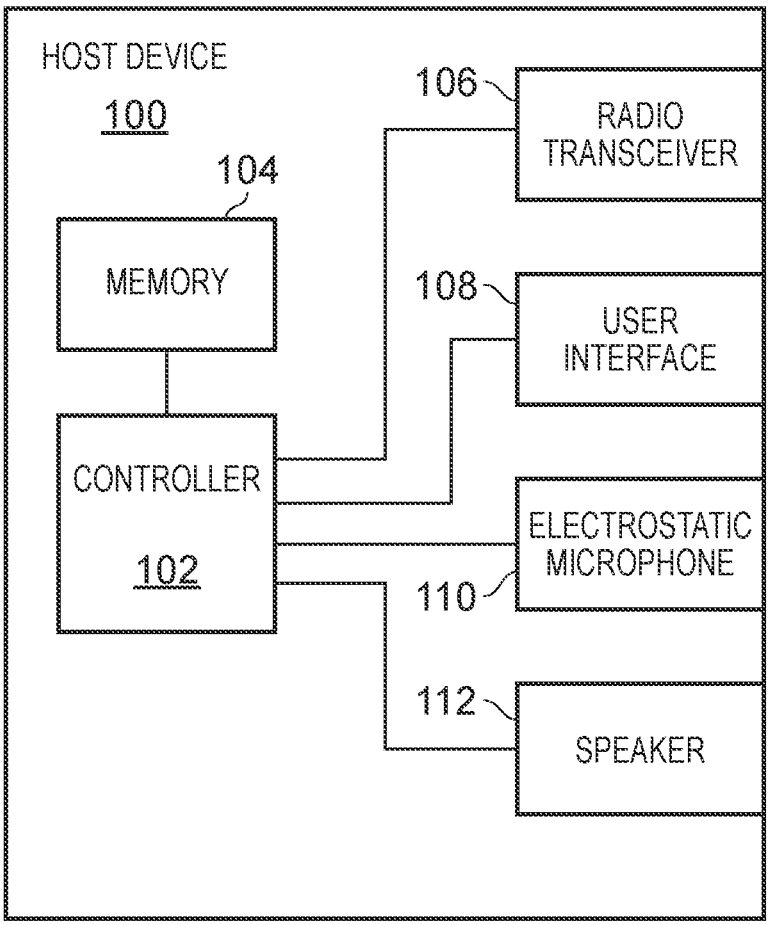
FIG. 1 is a schematic diagram of a host device.

FIG. 1 is a schematic diagram of a host device 100, which may be considered an electrical or electronic device. Host device 100 comprises audio circuitry 200 (not specifically shown) as will be explained in more detail in connection with FIG. 2.

As shown in FIG. 1, host device 100 comprises a controller 102, a memory 104, a radio transceiver 106, a user interface 108, at least one microphone 110, and at least one speaker unit 112.

The host device may comprise an enclosure, i.e. any suitable housing, casing, or other enclosure for housing the various components of host device 100. The enclosure may be constructed from plastic, metal, and/or any other suitable materials. In addition, the enclosure may be adapted (e.g., sized and shaped) such that host device 100 is readily transported by a user of host device 100. Accordingly, host device 100 includes but is not limited to a mobile telephone such as a smart phone, an audio player, a video player, a PDA, a mobile computing platform such as a laptop computer or tablet computing device, a handheld computing device, a games device, or any other device that may be readily transported by a user.

Controller 102 is housed within the enclosure and includes any system, device, or apparatus configured to interpret and/or execute program instructions and/or process data, and may include, without limitation a microprocessor, microcontroller, digital signal processor (DSP), application specific integrated circuit (ASIC), or any other digital or analogue circuitry configured to interpret and/or execute program instructions and/or process data. In some arrangements, controller 102 interprets and/or executes program instructions and/or processes data stored in memory 104 and/or other computer-readable media accessible to controller 102.

Memory 104 may be housed within the enclosure, may be communicatively coupled to controller 102, and includes any system, device, or apparatus configured to retain program instructions and/or data for a period of time (e.g., computer-readable media). Memory 104 may include random access memory (RAM), electrically erasable programmable read-only memory (EEPROM), a Personal Computer Memory Card International Association (PCMCIA) card, flash memory, magnetic storage, opto-magnetic storage, or any suitable selection and/or array of volatile or non-volatile memory that retains data after power to host device 100 is turned off.

User interface 108 may be housed at least partially within the enclosure, may be communicatively coupled to the controller 102, and comprises any instrumentality or aggregation of instrumentalities by which a user may interact with user host device 100. For example, user interface 108 may permit a user to input data and/or instructions into user host device 100 (e.g., via a keypad and/or touch screen), and/or otherwise manipulate host device 100 and its associated components. User interface 108 may also permit host device 100 to communicate data to a user, e.g., by way of a display device (e.g. touch screen).

Capacitive microphone 110 may be housed at least partially within the enclosure, may be communicatively coupled to controller 102, and comprise any system, device, or apparatus configured to convert sound incident at microphone 110 to an electrical signal that may be processed by controller 102, wherein such sound is converted to an electrical signal using a diaphragm or membrane having an electrical capacitance that varies as based on sonic vibrations received at the diaphragm or membrane. Capacitive microphone 110 may include an electrostatic microphone, a condenser microphone, an electret microphone, a microelectromechanical systems (MEMS) microphone, or any other suitable capacitive microphone. In some arrangements multiple capacitive microphones 110 may be provided and employed selectively or together. In some arrangements the capacitive microphone 110 may not be provided, the speaker unit 112 being relied upon to serve as a microphone as explained later.

Radio transceiver 106 may be housed within the enclosure, may be communicatively coupled to controller 102, and includes any system, device, or apparatus configured to, with the aid of an antenna, generate and transmit radio-frequency signals as well as receive radio-frequency signals and convert the information carried by such received signals into a form usable by controller 102. Of course, radio transceiver 106 may be replaced with only a transmitter or only a receiver in some arrangements. Radio transceiver 106 may be configured to transmit and/or receive various types of radio-frequency signals, including without limitation, cellular communications (e.g., 2G, 3G, 4G, LTE, etc.), short-range wireless communications (e.g., BLUETOOTH), commercial radio signals, television signals, satellite radio signals (e.g., GPS), Wireless Fidelity, etc.

The speaker unit 112 comprises a speaker (possibly along with supporting circuitry) and may be housed at least partially within the enclosure or may be external to the enclosure (e.g. attachable thereto in the case of headphones). As will be explained later, the audio circuitry 200 described in connection with FIG. 2 may be taken to correspond to the speaker unit 112 or to a combination of the speaker unit 112 and the controller 102. It will be appreciated that in some arrangements multiple speaker units 112 may be provided and employed selectively or together. As such the audio circuitry 200 described in connection with FIG. 2 may be taken to be provided multiple times corresponding respectively to the multiple speaker units 112, although it need not be provided for each of those speaker units 112. The present disclosure will be understood accordingly.

The speaker unit 112 may be communicatively coupled to controller 102, and may comprise any system, device, or apparatus configured to produce sound in response to electrical audio signal input. In some arrangements, the speaker unit 112 may comprise as its speaker a dynamic loudspeaker.

A dynamic loudspeaker may be taken to employ a lightweight diaphragm mechanically coupled to a rigid frame via a flexible suspension that constrains a voice coil to move axially through a cylindrical magnetic gap. When an electrical signal is applied to the voice coil, a magnetic field is created by the electric current in the voice coil, making it a variable electromagnet. The coil and the driver's magnetic system interact, generating a mechanical force that causes the coil (and thus, the attached cone) to move back and forth, thereby reproducing sound under the control of the applied electrical signal coming from the amplifier.

The speaker unit 112 may be considered to comprise as its speaker any audio transducer, including amongst others a microspeaker, loudspeaker, ear speaker, headphone, earbud or in-ear transducer, piezo speaker, and an electrostatic speaker.

In arrangements in which host device 100 includes a plurality of speaker units 112, such speakers unit 112 may serve different functions. For example, in some arrangements, a first speaker unit 112 may play ringtones and/or other alerts while a second speaker unit 112 may play voice data (e.g., voice data received by radio transceiver 106 from another party to a phone call between such party and a user of host device 100). As another example, in some arrangements, a first speaker unit 112 may play voice data in a "speakerphone" mode of host device 100 while a second speaker unit 112 may play voice data when the speakerphone mode is disabled.

Although specific example components are depicted above in FIG. 1 as being integral to host device 100 (e.g., controller 102, memory 104, user interface 108, microphone 110, radio transceiver 106, speaker(s) unit 112), in some arrangements the host device 100 may comprise one or more components not specifically enumerated above. In other arrangements the host device 100 may comprise a subset of the components specifically enumerated above, for example it might not comprise the radio transceiver 106 and/or the microphone 110.

As mentioned above, one or more speakers units 112 may be employed as a microphone. For example, sound incident on a cone or other sound producing component of a speaker unit 112 may cause motion in such cone, thus causing motion of the voice coil of such speaker unit 112, which induces a voltage on the voice coil which may be sensed and transmitted to controller 102 and/or other circuitry for processing, effectively operating as a microphone. Sound detected by a speaker unit 112 used as a microphone may be used for many purposes.

For example, in some arrangements a speaker unit 112 may be used as a microphone to sense voice commands and/or other audio stimuli. These may be employed to carry out predefined actions (e.g. predefined voice commands may be used to trigger corresponding predefined actions).

Voice commands and/or other audio stimuli may be employed for "waking up" the host device 100 from a low-power state and transitioning it to a higher-power state. In such arrangements, when host device 100 is in a low-power state, a speaker unit 112 may communicate electronic signals (a microphone signal) to controller 102 for processing. Controller 102 may process such signals and determine if such signals correspond to a voice command and/or other stimulus for transitioning host device 100 to a higher-power state. If controller 102 determines that such signals correspond to a voice command and/or other stimulus for transitioning host device 100 to a higher-power state, controller 102 may activate one or more components of host device 100 that may have been deactivated in the low-power state (e.g., capacitive microphone 110, user interface 108, an applications processor forming part of the controller 102).

In some instances, a speaker unit 112 may be used as a microphone for sound pressure levels or volumes above a certain level, such as the recording of a live concert, for example. In such higher sound levels, a speaker unit 112 may have a more reliable signal response to sound as compared with capacitive microphone 110. When using a speaker unit 112 as a microphone, controller 102 and/or other components of host device 100 may perform frequency equalization, as the frequency response of a speaker unit 112 employed as a microphone may be different than capacitive microphone 110. Such frequency equalization may be accomplished using filters (e.g., a filter bank) as is known in the art. In particular arrangements, such filtering and frequency equalization may be adaptive, with an adaptive filtering algorithm performed by controller 102 during periods of time in which both capacitive microphone 110 is active (but not overloaded by the incident volume of sound) and a speaker unit 112 is used as a microphone. Once the frequency response is equalized, controller 102 may smoothly transition between the signals received from capacitive microphone 110 and speaker unit 112 by cross-fading between the two.

In some instances, a speaker unit 112 may be used as a microphone to enable identification of a user of the host device 100. For example, a speaker unit 112 (e.g.

implemented as a headphone, earpiece or earbud) may be used as a microphone while a speaker signal is supplied to the speaker (e.g. to play sound such as music) or based on noise. In that case, the microphone signal may contain information about the ear canal of the user, enabling the user to be identified by analysing the microphone signal. For example, the microphone signal may indicate how the played sound or noise resonates in the ear canal, which may be specific to the ear canal concerned. Since the shape and size of each person's ear canal is unique, the resulting data could be used to distinguish a particular (e.g. "authorised") user from other users. Accordingly, the host device 100 (including the speaker unit 112) may be configured in this way to perform a biometric check, similar to a fingerprint sensor or eye scanner.

It will be apparent that in some arrangements, a speaker unit 112 may be used as a microphone in those instances in which it is not otherwise being employed to emit sound. For example, when host device 100 is in a low-power state, a speaker unit 112 may not emit sound and thus may be employed as a microphone (e.g., to assist in waking host device 100 from the low-power state in response to voice activation commands, as described above). As another example, when host device 100 is in a speakerphone mode, a speaker unit 112 typically used for playing voice data to a user when host device 100 is not in a speakerphone mode (e.g., a speaker unit 112 the user typically holds to his or her ear during a telephonic conversation) may be deactivated from emitting sound and in such instance may be employed as a microphone.

However, in other arrangements (for example, in the case of the biometric check described above), a speaker unit 112 may be used simultaneously as a speaker and a microphone, such that a speaker unit 112 may simultaneously emit sound while capturing sound. In such arrangements, a cone and voice coil of a speaker unit 112 may vibrate both in response to a voltage signal applied to the voice coil and other sound incident upon speaker unit 112. As will become apparent from FIG. 2, the controller 102 and/or the speaker unit 112 may determine a current flowing through the voice coil, which will exhibit the effects of: a voltage signal used to drive the speaker (e.g., based on a signal from the controller 102); and a voltage induced by external sound incident on the speaker unit 112. It will become apparent from FIG. 2 how the audio circuitry 200 enables a microphone signal (attributable to the external sound incident on the speaker of the speaker unit 112) to be recovered in this case.

In these and other arrangements, host device 100 may include at least two speaker units 112 which may be selectively used to transmit sound or as a microphone. In such arrangements, each speaker unit 112 may be optimized for performance at a particular volume level range and/or frequency range, and controller 102 may select which speaker unit(s) 112 to use for transmission of sound and which speaker unit(s) 112 to use for reception of sound based on detected volume level and/or frequency range.

Figure 2:
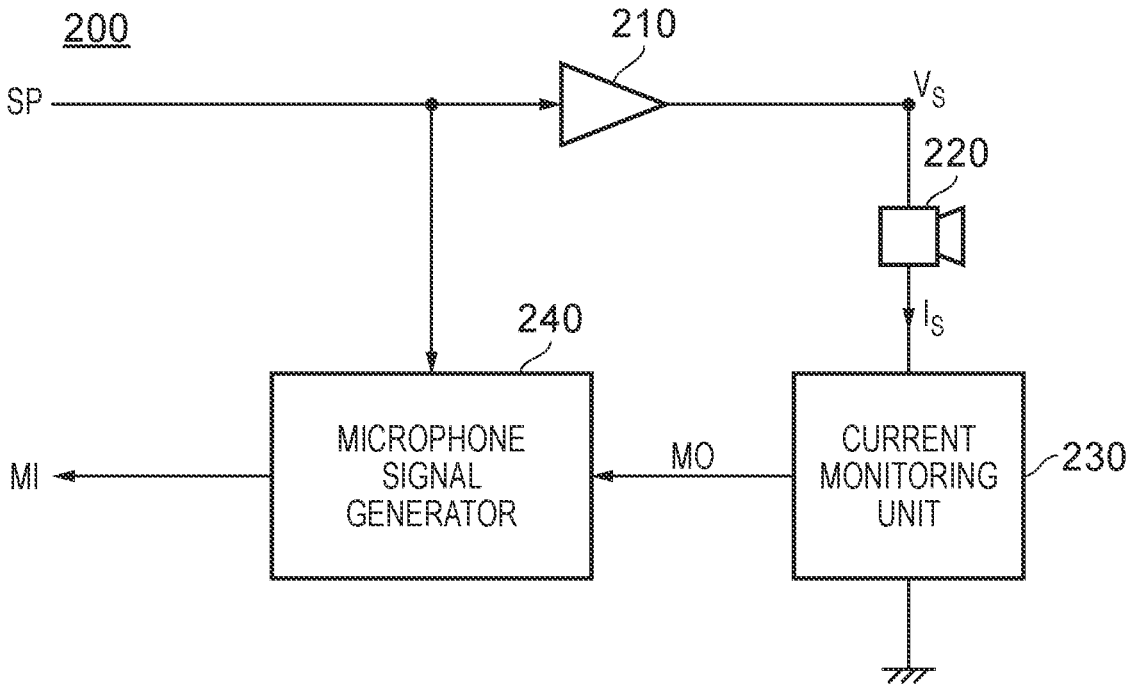
FIG. 2 is a schematic diagram of audio circuitry for use in the FIG. 1 host device.

FIG. 2 is a schematic diagram of the audio circuitry 200. The audio circuitry comprises a speaker driver 210, a speaker 220, a current monitoring unit 230 and a microphone signal generator 240.

For ease of explanation the audio circuitry 200 (including the speaker 220) will be considered hereinafter to correspond to the speaker unit 112 of FIG. 1, with the signals SP and MI in FIG. 2 (described later) effectively being communicated between the audio circuitry 200 and the controller 102.

The speaker driver 210 is configured, based on a speaker signal SP, to drive the speaker 220, in particular to drive a given speaker voltage signal $V_S$ on a signal line to which the speaker 220 is connected. The speaker 220 is connected between the signal line and ground, with the current monitoring unit 230 connected such that a speaker current $I_S$ flowing through the speaker 220 is monitored by the current monitoring unit 230.

Of course, this arrangement is one example, and in another arrangement the speaker 220 could be connected between the signal line and supply, again with the current monitoring unit 230 connected such that a speaker current $I_S$ flowing through the speaker 220 is monitored by the current monitoring unit 230. In yet another arrangement, the speaker driver 210 could be an H-bridge speaker driver with the speaker 220 then connected to be driven, e.g. in antiphase, at both ends. Again, the current monitoring unit 230 would be connected such that a speaker current $I_S$ flowing through the speaker 220 is monitored by the current monitoring unit 230. The present disclosure will be understood accordingly.

Returning to FIG. 2, the speaker driver 210 may be an amplifier such as a power amplifier. In some arrangements the speaker signal SP may be a digital signal, with the speaker driver 210 being digitally controlled. The voltage signal $V_S$ (effectively, the potential difference maintained over the combination of the speaker 220 and the current monitoring unit 230, indicative of the potential difference maintained over the speaker 220) may be an analogue voltage signal controlled based on the speaker signal SP. Of course, the speaker signal SP may also be an analogue signal. In any event, the speaker signal SP is indicative of a voltage signal applied to the speaker. That is, the speaker driver 210 may be configured to maintain a given voltage level of the voltage signal $V_S$ for a given value for the speaker signal SP, so that the value of the voltage signal $V_S$ is controlled by or related to (e.g. proportional to, at least within a linear operating range) the value of the speaker signal SP.

The speaker 220 may comprise a dynamic loudspeaker as mentioned above. Also as mentioned above, the speaker 220 may be considered any audio transducer, including amongst others a microspeaker, loudspeaker, ear speaker, headphone, earbud or in-ear transducer, piezo speaker, and an electrostatic speaker.

The current monitoring unit 230 is configured to monitor the speaker current $I_S$ flowing through the speaker and generate a monitor signal MO indicative of that current. The monitor signal MO may be a current signal or may be a voltage signal or digital signal indicative of (e.g. related to or proportional to) the speaker current $I_S$.

The microphone signal generator 240 is connected to receive the speaker signal SP and the monitor signal MO. The microphone signal generator 240 is operable, when external sound is incident on the speaker 220, to generate a microphone signal MI representative of the external sound, based on the monitor signal MO and the speaker signal SP. Of course, the speaker voltage signal $V_S$ is related to the speaker signal SP, and as such the microphone signal generator 240 may be connected to receive the speaker voltage signal $V_S$ instead of (or as well as) the speaker signal SP, and be operable to generate the microphone signal MI based thereon. The present disclosure will be understood accordingly.

As above, the speaker signal SP may be received from the controller 102, and the microphone signal MI may be provided to the controller 102, in the context of the host device 100. However, it will be appreciated that the audio circuitry 200 may be provided other than as part of the host device 100 in which case other control or processing circuitry may be provided to supply the speaker signal SP and receive the microphone signal MI, for example in a coupled accessory, e.g. a headset or earbud device.

Figure 3A:
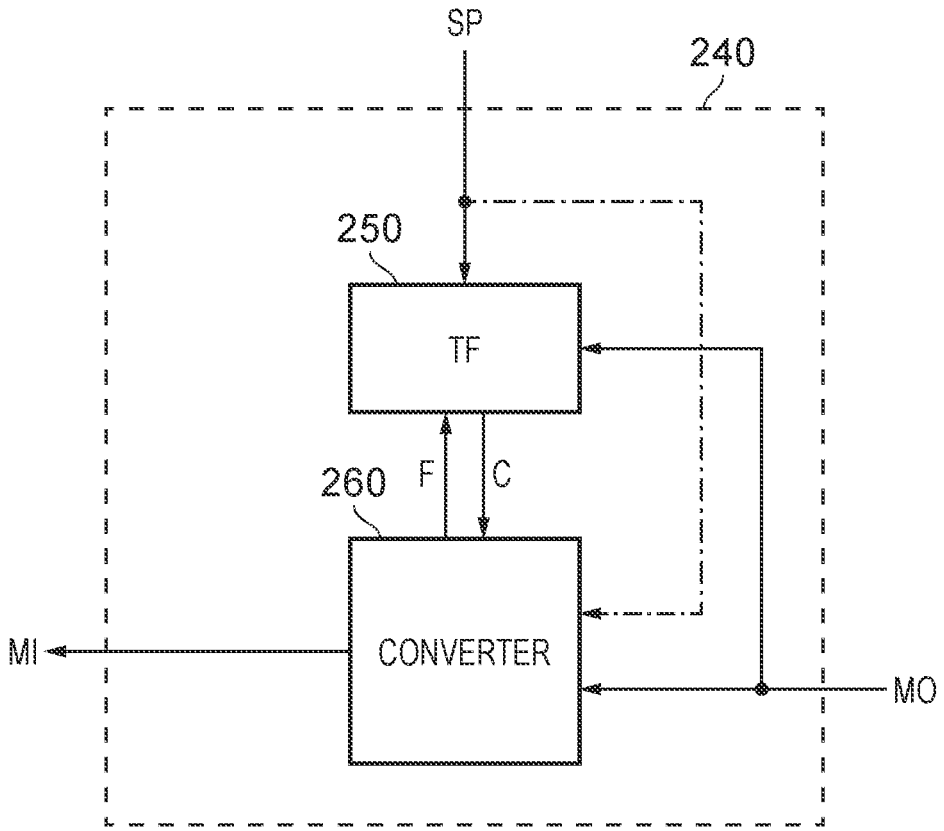
FIG. 3A is a schematic diagram of one implementation of the microphone signal generator of FIG. 2.

FIG. 3A is a schematic diagram of one implementation of the microphone signal generator 240 of FIG. 2. The microphone signal generator 240 in the FIG. 3A implementation comprises a transfer function unit 250 and a converter 260.

The transfer function unit 250 is connected to receive the speaker signal SP and the monitor signal MO, and to define and implement a transfer function which models (or is representative of, or simulates) at least the speaker 220. The transfer function may additionally model the speaker driver 210 and/or the current monitoring unit 230.

As such, the transfer function models in particular the performance of the speaker. Specifically, the transfer function (a transducer model) models how the speaker current $I_s$ is expected to vary based on the speaker signal SP (or the speaker voltage signal $V_S$) and any sound incident on the speaker 220. This of course relates to how the monitor signal MO will vary based on the same influencing factors.

By receiving the speaker signal SP and the monitor signal MO, the transfer function unit 250 is capable of defining the transfer function adaptively. That is the transfer function unit 250 is configured to determine the transfer function or parameters of the transfer function based on the monitor signal MO and the speaker signal SP. For example, the transfer function unit 250 may be configured to define, redefine or update the transfer function or parameters of the transfer function over time. Such an adaptive transfer function (enabling the operation of the converter 260 to be adapted as below) may adapt slowly and also compensate for delay and frequency response in the voltage signal applied to the speaker as compared to the speaker signal SP.

As one example, a pilot tone significantly below speaker resonance may be used (by way of a corresponding speaker signal SP) to adapt or train the transfer function. This may be useful for low-frequency response or overall gain. A pilot tone significantly above speaker resonance (e.g. ultrasonic) may be similarly used for high-frequency response, and a low-level nose signal may be used for the audible band. Of course, the transfer function may be adapted or trained using audible sounds e.g. in an initial setup or calibration phase, for example in factory calibration.

This adaptive updating of the transfer function unit 250 may operate most readily when there is no (incoming) sound incident on the speaker 220. However, over time the transfer function may iterate towards the "optimum" transfer function even when sound is (e.g. occasionally) incident on the speaker 220. Of course, the transfer function unit 250 may be provided with an initial transfer function or initial parameters of the transfer function (e.g. from memory) corresponding to a "standard" speaker 220, as a starting point for such adaptive updating.

For example, such an initial transfer function or initial parameters (i.e. parameter values) may be set in a factory calibration step, or pre-set based on design/prototype characterisation. For example, the transfer function unit 250 may be implemented as a storage of such parameters (e.g. coefficients). A further possibility is that the initial transfer function or initial parameters may be set based on extracting parameters in a separate process used for speaker protection purposes, and then deriving the initial transfer function or initial parameters based on those extracted parameters.

The converter 260 is connected to receive a control signal C from the transfer function unit 250, the control signal C reflecting the transfer function or parameters of the transfer function so that it defines the operation of the converter 260. Thus, the transfer function unit 250 is configured by way of the control signal C to define, redefine or update the operation of the converter 260 as the transfer function or parameters of the transfer function change. For example, the transfer function of the transfer function unit 250 may over time be adapted to better model at least the speaker 220.

The converter 260 (e.g. a filter) is configured to convert the monitor signal MO into the microphone signal MI, in effect generating the microphone signal MI. As indicated by the dot-dash signal path in FIG. 3, the converter 260 (as defined by the control signal C) may be configured to generate the microphone signal MI based on the speaker signal SP and the monitor signal MO.

Note that the converter 260 is shown in FIG. 3A as also supplying a feedback signal F to the transfer function unit 250. The use of the feedback signal F in this way is optional. It will be understood that the transfer function unit 250 may receive the feedback signal F from the converter 260, such that the transfer function modelled by the transfer function unit 250 can be adaptively updated or tuned based on the feedback signal F, e.g. based on an error signal F received from the converter unit 260. The feedback signal F may be supplied to the transfer function unit 250 instead of or in addition to the monitor signal MO. In this regard, a detailed implementation of the microphone signal generator 240 will be explored later in connection with FIG. 3B.

It will be appreciated that there are four basic possibilities in relation to the speaker 220 emitting sound and receiving incoming sound. These will be considered in turn. For convenience the speaker signal SP will be denoted an "emit" speaker signal when it is intended that the speaker emits sound (e.g. to play music) and a "non-emit" speaker signal when it is intended that the speaker does not, or substantially does not, emit sound (corresponding to the speaker being silent or appearing to be off). An emit speaker signal may be termed a "speaker on", or "active" speaker signal, and have values which cause the speaker to emit sound (e.g. to play music). A non-emit speaker signal may be termed a "speaker off", or "inactive" or "dormant" speaker signal, and have a value or values which cause the speaker to not, or substantially not, emit sound (corresponding to the speaker being silent or appearing to be off).

The first possibility is that the speaker signal SP is an emit speaker signal, and that there is no significant (incoming) sound incident on the speaker 220 (even based on reflected or echoed emitted sound). In this case the speaker driver 210 is operable to drive the speaker 220 so that it emits a corresponding sound signal, and it would be expected that the monitor signal MO comprises a speaker component resulting from (attributable to) the speaker signal but no microphone component resulting from external sound (in the ideal case). There may of course be other components, e.g. attributable to circuit noise.

This first possibility may be particularly suitable for the transfer function unit 250 to define/redefine/update the transfer function based on the speaker signal SP and the monitor signal MO, given the absence of a microphone component resulting from external sound. The converter 260 here (in the ideal case) outputs the microphone signal MI such that it indicates no (incoming) sound incident on the speaker, i.e. silence. Of course, in practice there may always be a microphone component if only a small, negligible one.

The second possibility is that the speaker signal SP is an emit speaker signal, and that there is significant (incoming) sound incident on the speaker 220 (perhaps based on reflected or echoed emitted sound). In this case the speaker driver 210 is again operable to drive the speaker 220 so that it emits a corresponding sound signal. Here, however, it would be expected that the monitor signal MO comprises a speaker component resulting from (attributable to) the speaker signal and also a significant microphone component resulting from the external sound (effectively due to a back EMF caused as the incident sound applies a force to the speaker membrane). There may of course be other components, e.g. attributable to circuit noise. In this second possibility, the converter 260 outputs the microphone signal MI such that it represents the (incoming) sound incident on the speaker. That is, the converter 260 effectively filters out the speaker component and/or equalises and/or isolates the microphone component when converting the monitor signal MO into the microphone signal MI.

The third possibility is that the speaker signal SP is a non-emit speaker signal, and that there is significant (incoming) sound incident on the speaker 220. In this case the speaker driver 210 is operable to drive the speaker 220 so that it substantially does not emit a sound signal. For example, the speaker driver 210 may drive the speaker 220 with a speaker voltage signal Vs which is substantially a DC signal, for example at 0V relative to ground. Here, it would be expected that the monitor signal MO comprises a significant microphone component resulting from the external sound but no speaker component. There may of course be other components, e.g. attributable to circuit noise. In the third possibility, the converter 260 outputs the microphone signal MI again such that it represents the (incoming) sound incident on the speaker. In this case, the converter effectively isolates the microphone component when converting the monitor signal MO into the microphone signal MI.

The fourth possibility is that the speaker signal SP is a non-emit speaker signal, and that there is no significant (incoming) sound incident on the speaker 220. In this case the speaker driver 210 is again operable to drive the speaker 220 so that it substantially does not emit a sound signal. Here, it would be expected that the monitor signal MO comprises neither a significant microphone component nor a speaker component. There may of course be other components, e.g. attributable to circuit noise. In the fourth possibility, the converter 260 outputs the microphone signal MI such that it indicates no (incoming) sound incident on the speaker, i.e. silence.

At this juncture, it is noted that the monitor signal MO is indicative of the speaker current $I_S$ rather than a voltage such as the speaker voltage signal $V_S$. Although it would be possible for the monitor signal MO to be indicative of a voltage such as the speaker voltage signal $V_S$ in a case where the speaker driver 210 is effectively disconnected (such that the speaker 220 is undriven) and replaced with a sensing circuit (such as an analogue-to-digital converter), this mode of operation may be unsuitable or inaccurate where the speaker 220 is driven by the speaker driver 210 (both where the speaker signal SP is a non-emit speaker signal and an emit speaker signal) and there is significant sound incident on the speaker 220.

This is because the speaker driver 210 effectively forces the speaker voltage signal $V_S$ to have a value based on the value of the speaker signal SP as mentioned above. Thus, any induced voltage effect (Vemf due to membrane displacement) of significant sound incident on the speaker 220 would be largely or completely lost in e.g. the speaker voltage signal $V_S$ given the likely driving capability of the speaker driver 210. However, the speaker current $I_S$ in this case would exhibit components attributable to the speaker signal and also any significant incident external sound, which translate into corresponding components in the monitor signal MO (where it is indicative of the speaker current $I_S$) as discussed above. As such, having the monitor signal MO indicative of the speaker current $I_S$ as discussed above enables a common architecture to be employed for all four possibilities mentioned above.

Although not explicitly shown in FIG. 3A, the converter 260 may be configured to perform conversion so that the microphone signal MI is output as a signal which is more usefully representative of the external sound (e.g. as a sound pressure level signal). Such conversion may involve some scaling and possibly some equalisation over frequency, for example. The monitor signal MO is indicative of the current signal $I_s$, and may even be a current signal itself. However, the circuitry such as controller 102 receiving the microphone signal MI may require that signal MI to be a sound pressure level (SPL) signal. The converter 260 may be configured to perform the conversion in accordance with a corresponding conversion function. As such, the converter 260 may comprise a conversion function unit (not shown) equivalent to the transfer function unit 250 and which is similarly configured to update, define or redefine the conversion function being implemented in an adaptive manner, for example based on any or all of the monitor signal MO, the speaker signal SP, the microphone signal MI, the feedback signal F, and the control signal C.

The skilled person will appreciate, in the context of the speaker 220, that the transfer function and/or the conversion function may be defined at least in part by Thiele-Small parameters. Such parameters may be reused from speaker protection or other processing. Thus, the operation of the transfer function unit 250, the converter 260 and/or the conversion function unit (not shown) may be defined at least in part by such Thiele-Small parameters. As is well known, Thiele-Small parameters (Thiele/Small parameters, TS parameters or TSP) are a set of electromechanical parameters that define the specified low frequency performance of a speaker. These parameters may be used to simulate or model the position, velocity and acceleration of the diaphragm, the input impedance and the sound output of a system comprising the speaker and its enclosure.

Figure 3B:
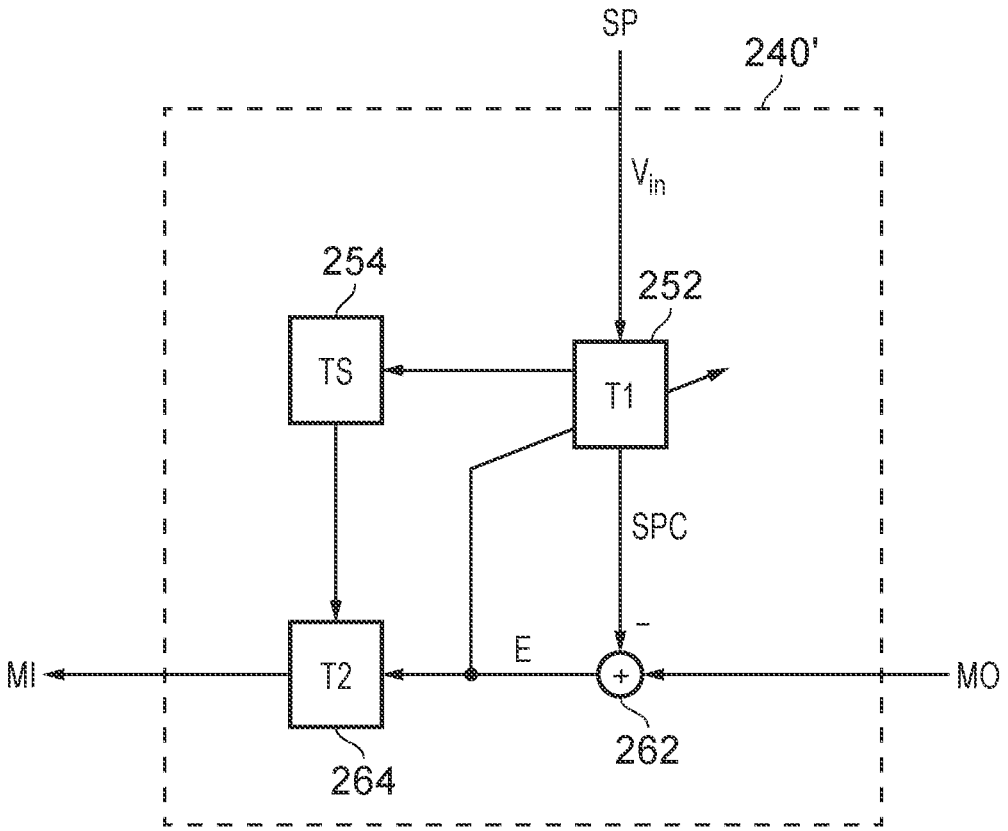
FIG. 3B is a schematic diagram of another implementation of the microphone signal generator of FIG. 2.

FIG. 3B is a schematic diagram of one implementation of the microphone signal generator 240 of FIG. 2, here denoted 240'. The microphone signal generator 240' in the FIG. 3B implementation comprises a first transfer function unit 252, an adder/subtractor 262, a second transfer function unit 264 and a TS parameter unit 254.

The first transfer function unit 252 is configured to define and implement a first transfer function, T1. The second transfer function unit 264 is configured to define and implement a second transfer function, T2. The TS parameter unit 254 is configured to store TS (Thiele-Small) parameters or coefficients extracted from the first transfer function T1 to be applied to the second transfer function T2.

The first transfer function, T1, may be considered to model at least the speaker 220. The first transfer function unit 252 is connected to receive the speaker signal SP (which will be referred to here as $V_{in}$), and to output a speaker current signal SPC indicative of the expected or predicted (modelled) speaker current based on the speaker signal SP.

The adder/subtractor 262 is connected to receive the monitor signal MO (indicative of the actual speaker current $I_S$) and the speaker current signal SPC, and to output an error signal E which is indicative of the residual current representative of the external sound incident on the speaker 220. As indicated in FIG. 3B, the first transfer function unit 252, and as such the first transfer function T1, is configured to be adaptive based on the error signal E supplied to the first transfer function unit 252. The error signal E in FIG. 3B may be compared with the feedback signal F in FIG. 3A.

The second transfer function, T2, may be suitable to convert the error signal output by the adder/subtractor 262 into a suitable SPL signal (forming the microphone signal MI) as mentioned above. Parameters or coefficients of the first transfer function T1 may be stored in the TS parameter unit 254 and applied to the second transfer function T2.

The first transfer function T1 may be referred to as an adaptive filter. The parameters or coefficients (in this case, Thiele-Small coefficients TS) of the first transfer function T1 may be extracted and applied to the second transfer function T2, by way of the TS parameter unit 254, which may be a storage unit. The second transfer function T2 may be considered an equalisation filter.

Looking at FIG. 3B, for example, T2 is the transfer function applied between E and MI, hence T2=(MI/E), or MI=T2*E, where E=(MO−SPC). Similarly, T1=(SPC/SP), or SPC=T1*SP.

Example transfer functions T1 and T2 derived from Thiele-Small modelling may comprise:

$$T1 = \frac{Vin}{R + s\left(L + \frac{Bl^2.Cms}{1 + s.Cms(Rms + Mms)}\right)}$$

$$T2 = -\frac{R(1 + s.Cms(Rms + Mms)) + s(L + Cms(-Bl^2 + L.s(Rms + Mms)))}{s.Bl.Cms}$$

where:

Vin is the voltage level of (or indicated by) the speaker signal SP;

R is equivalent to Re, which is the DC resistance (DCR) of the voice coil measured in ohms (Ω), and best measured with the speaker cone blocked, or prevented from moving or vibrating;

L is equivalent to Le, which is the inductance of the voice coil measured in millihenries (mH);

BI is known as the force factor, and is a measure of the force generated by a given current flowing through the voice coil of the speaker, and is measured in tesla metres (Tm);

Cms describes the compliance of the suspension of the speaker, and is measured in metres per Newton (m/N);

Rms is a measurement of the losses or damping in the speaker's suspension and moving system. Units are not normally given but it is in mechanical 'ohms';

Mms is the mass of the cone, coil and other moving parts of a driver, including the acoustic load imposed by the air in contact with the driver cone, and is measured in grams (g) or kilograms (kg);

s is the Laplace variable; and

In general, reference regarding Thiele-Small parameters may be made to Beranek, Leo L. (1954). Acoustics. NY: McGraw-Hill.

Figure 4:
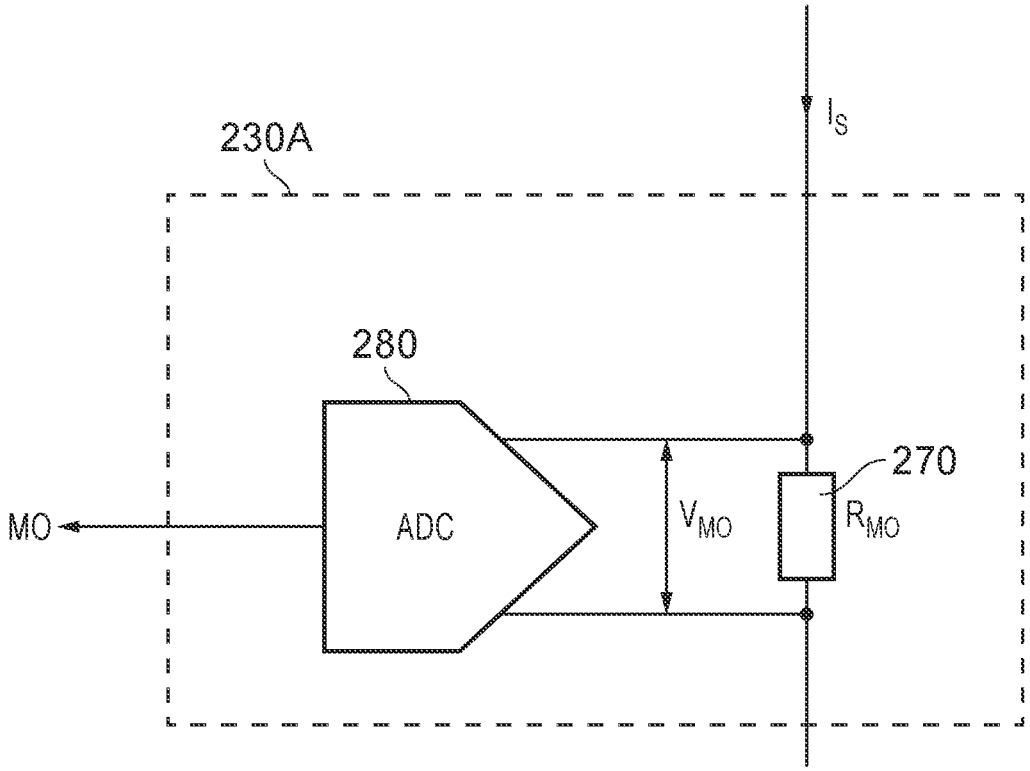
FIG. 4 is a schematic diagram of an example current monitoring unit, as an implementation of the current monitoring unit of FIG. 2.

FIG. 4 is a schematic diagram of an example current monitoring unit 230A which may be considered an implementation of the current monitoring unit 230 of FIG. 2. The current monitoring unit 230A may thus be used in place of the current monitoring unit 230.

The current monitoring unit 230A comprises an impedance 270 and an analogue-to-digital converter (ADC) 280. The impedance 270 is in the present arrangement a resistor having a monitoring resistance $R_{MO}$, and is connected in series in the current path carrying the speaker current $I_S$. Thus a monitoring voltage $V_{MO}$, is developed over the resistor 270 such that:

$$V_{MO}=I_S \times R_{MO}$$

The monitoring voltage $V_{MO}$ is thus proportional to the speaker current $I_S$ given the fixed monitoring resistance $R_{MO}$ of the resistor 270. Indeed, it will be appreciated from the above equation that the speaker current $I_S$ could readily be obtained from the monitoring voltage $V_{MO}$ given a known $R_{MO}$.

The ADC 280 is connected to receive the monitoring voltage $V_{MO}$ is an analogue input signal and to output the monitor signal MO as a digital signal. The microphone signal generator 240 (including the transfer function unit 250 and converter 260) may be implemented in digital such that the speaker signal SP, the monitor signal MO and the microphone signal MI are digital signals.

Figure 5:
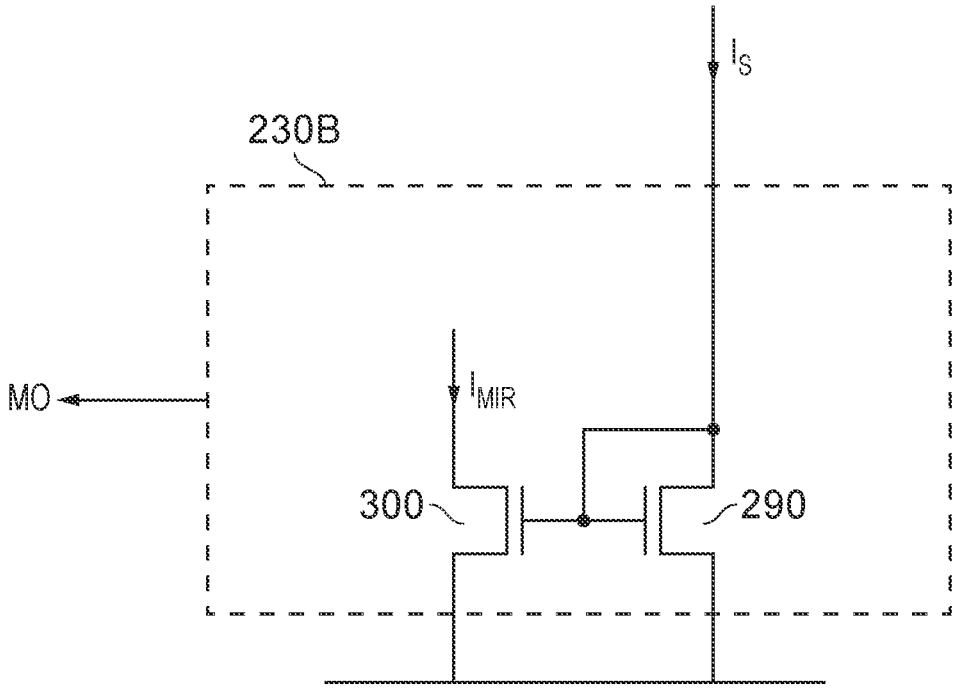
FIG. 5 is a schematic diagram of another example current monitoring unit, as an implementation of the current monitoring unit of FIG. 2.

FIG. 5 is a schematic diagram of an example current monitoring unit 230B which may be considered an implementation of the current monitoring unit 230 of FIG. 2. The current monitoring unit 230B may thus be used in place of the current monitoring unit 230, and indeed along with elements of the current monitoring unit 230A as will become apparent. Other known active sensing techniques such as a current mirror with drain-source voltage matching may be used.

The current monitoring unit 230B comprises first and second transistors 290 and 300 connected in a current-mirror arrangement. The first transistor 290 is connected in series in the current path carrying the speaker current Is such that a mirror current IMIR is developed in the second transistor 300. The mirror current IMIR may be proportional to the speaker current $I_S$ dependent on the current-mirror arrangement (for example, the relative sizes of the first and second transistors 290 and 300). For example, the current-mirror arrangement may be configured such that the mirror current IMIR is equal to the speaker current $I_S$. In FIG. 5, the first and second transistors 290 and 300 are shown as MOSFETs however it will be appreciated that other types of transistor (such as bipolar junction transistors) could be used.

The current monitoring unit 230B is configured to generate the monitor signal MO based on the mirror current IMIR. For example, an impedance in the path of the mirror current IMIR along with an ADC—equivalent to the impedance 270 and ADC 280 of FIG. 4—could be used to generate the monitor signal MO based on the mirror current $I_{MIR}$, and duplicate description is omitted.

It will be appreciated from FIG. 2 that the audio circuitry 200 could be provided without the speaker 220, to be connected to such a speaker 220. The audio circuitry 200 could also be provided with the controller 102 or other processing circuitry, connected to supply the speaker signal SP and/or receive the microphone signal MI. Such processing circuitry could act as a speaker-signal generator operable to generate the speaker signal SP. Such processing circuitry could act as a microphone-signal analyser operable to analyse the microphone signal MI.

Figure 6:
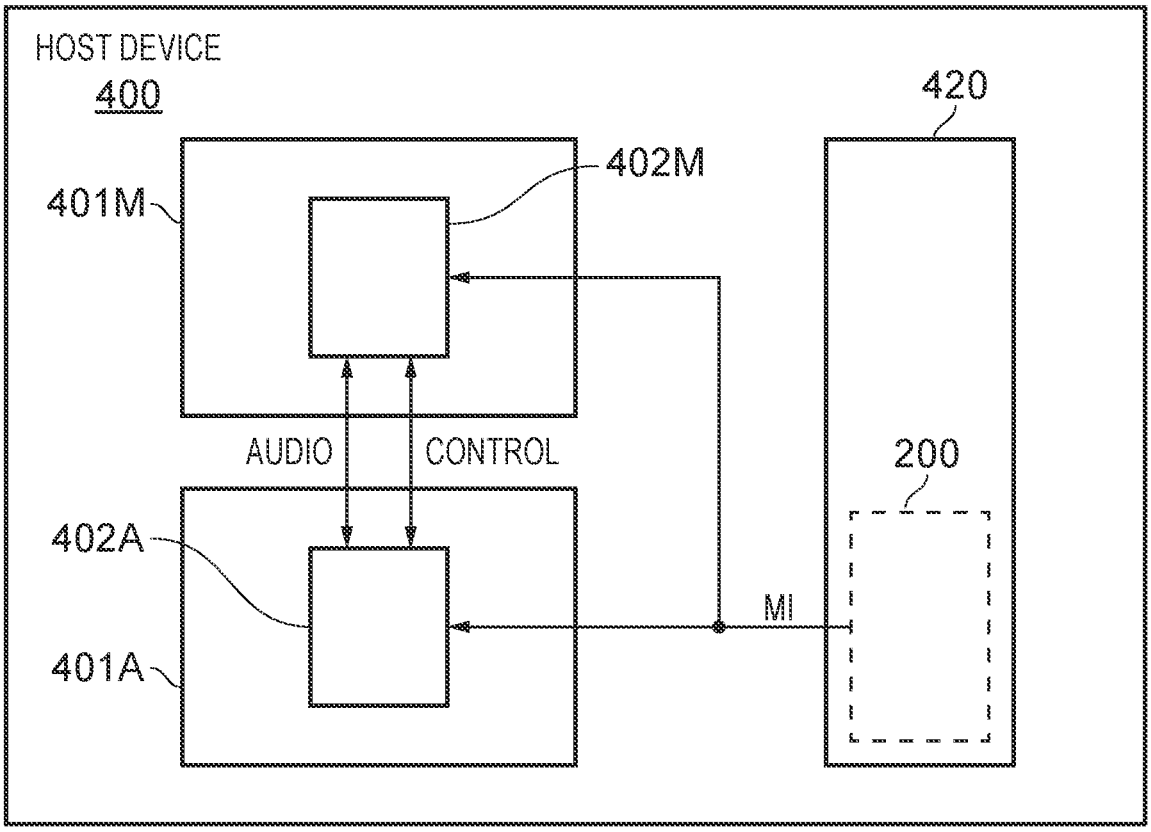
FIG. 6 is a schematic diagram of another host device.

FIG. 6 is a schematic diagram of a host device 400, which may be described as (or as comprising) an audio processing system. Host device 400 corresponds to host device 100, and as such host device 100 may also be described as (or as comprising) an audio processing system. However, the elements of host device 400 explicitly shown in FIG. 6 correspond only to a subset of the elements of host device 100 for simplicity.

The host device 400 is organised into an "always on" domain 401A and a "main" domain 401M. An "always on" controller 402A is provided in domain 401A and a "main" controller 402M is provided in domain 401M. The controllers 402A and 402M may be considered individually or collectively equivalent to the controller 102 of FIG. 1.

As described earlier, the host device 400 may be operable in a low-power state in which elements of the "always on" domain 401A are active and elements of the "main" domain 401M are inactive (e.g. off or in low-power state). The host 400 may be "woken up", transitioning it to a higher-power state in which the elements of the "main" domain 401M are active.

The host device 400 comprises an input/output unit 420 which may comprise one or more elements corresponding to elements 106, 108, 110 and 112 of FIG. 1. In particular, the input/output unit 420 comprises at least one set of audio circuitry 200 as indicated, which corresponds to a speaker unit 112 of FIG. 1.

As shown in FIG. 6, audio and/or control signals may be exchanged between the "always on" controller 402A and the "main" controller 402M. Also, one or both of the controllers 402A and 402M may be connected to receive the microphone signal MI from the audio circuitry 200. Although not shown, one or both of the controllers 402A and 402M may be connected to supply the speaker signal SP to the audio circuitry 200.

For example, the "always on" controller 402A may be configured to operate a voice-activity detect algorithm based on analysing or processing the microphone signal MI, and to wake up the "main" controller 402M via the control signals as shown when a suitable microphone signal MI is received. As an example, the microphone signal MI may be handled by the "always on" controller 402A initially and routed via that controller to the "main" controller 402M until such time as the "main" controller 402M is able to receive the microphone signal MI directly. In one example use case the host device 400 may be located on a table and it may be desirable to use the speaker 220 as a microphone (as well as any other microphones of the device 400) to detect a voice. It may be desirable to detect a voice when music is playing through the speaker 220.

As another example, the "main" controller 402M once woken up may be configured to operate a biometric algorithm based on analysing or processing the microphone signal MI to detect whether the ear canal of the user (where the speaker 220 is e.g. an earbud as described earlier) corresponds to the ear canal of an "authorised" user. Of course, this may equally be carried out by the "always on" controller 402A. The biometric algorithm may involve comparing the microphone signal MI or components thereof against one or more predefined templates or signatures. Such templates or signatures may be considered "environment" templates or signatures since they represent the environment in which the speaker 220 is or might be used, and indeed the environment concerned need not be an ear canal. For example, the environment could be a room or other space where the speaker 220 may receive incoming sound (which need not be reflected speaker sound), with the controller 402A and/or 402M analysing (evaluating/determining/judging) an environment in which the speaker 220 was or is being operated based on a comparison with such templates or signatures.

Of course, these are just example use cases of the host device 400 (and similarly of the host device 100). Other example use cases will occur to the skilled person based on the present disclosure.

The skilled person will recognise that some aspects of the above described apparatus (circuitry) and methods may be embodied as processor control code, for example on a non-volatile carrier medium such as a disk, CD- or DVD-ROM, programmed memory such as read only memory (Firmware), or on a data carrier such as an optical or electrical signal carrier. For example, the microphone signal generator 240 (and its sub-units 250, 260) may be implemented as a processor operating based on processor control code. As another example, the controllers 102, 402A, 402B may be implemented as a processor operating based on processor control code.

For some applications, such aspects will be implemented on a DSP (Digital Signal Processor), ASIC (Application Specific Integrated Circuit) or FPGA (Field Programmable Gate Array). Thus the code may comprise conventional program code or microcode or, for example, code for setting up or controlling an ASIC or FPGA. The code may also comprise code for dynamically configuring re-configurable apparatus such as re-programmable logic gate arrays. Similarly, the code may comprise code for a hardware description language such as Verilog TM or VHDL. As the skilled person will appreciate, the code may be distributed between a plurality of coupled components in communication with one another. Where appropriate, such aspects may also be implemented using code running on a field-(re)programmable analogue array or similar device in order to configure analogue hardware.

Some embodiments of the present invention may be arranged as part of an audio processing circuit, for instance an audio circuit (such as a codec or the like) which may be provided in a host device as discussed above. A circuit or circuitry according to an embodiment of the present invention may be implemented (at least in part) as an integrated circuit (IC), for example on an IC chip. One or more input or output transducers (such as speaker 220) may be connected to the integrated circuit in use.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in the claim, "a" or "an" does not exclude a plurality, and a single feature or other unit may fulfil the functions of several units recited in the claims. Any reference numerals or labels in the claims shall not be construed so as to limit their scope.

The invention claimed is:

1. Audio circuitry, comprising:

a speaker driver operable to drive a speaker based on a non-emit speaker signal so that it substantially does not emit a sound signal;

a current monitoring unit operable to monitor a speaker current flowing through the speaker and generate a monitor signal indicative of that current; and a microphone signal generator operable, when external sound is incident on the speaker, to generate a microphone signal representative of the external sound based on the monitor signal and the non-emit speaker signal;

wherein the microphone signal generator comprises a converter configured to convert the monitor signal into the microphone signal based on the non-emit speaker signal, the converter defined at least in part by a transfer function modelling at least the speaker.

2. The audio circuitry as claimed in claim 1, wherein:

the speaker driver is operable to force a voltage signal applied to the speaker to have a value based on a value of the non-emit speaker signal; and/or the speaker driver is operable to maintain a given potential difference over the speaker, or over a combination of the speaker and the current monitoring unit, for a given value of the non-emit speaker signal; and/or the speaker driver is operable to control a voltage signal applied to the speaker so as to maintain or tend to maintain a given relationship between the non-emit speaker signal and the voltage signal.

3. The audio circuitry as claimed in claim 1, wherein the current monitoring unit is operable to monitor the speaker current flowing through the speaker while the speaker driver is forcing a voltage signal applied to the speaker to have a value based on a value of the non-emit speaker signal.

4. The audio circuitry as claimed in claim 1, wherein:

the speaker driver is operable, based on the non-emit speaker signal, to drive the speaker with a speaker voltage signal which is substantially a DC signal such as at zero Volts relative to ground; and/or the speaker driver is operable, based on the non-emit speaker signal, to maintain a DC potential difference over the speaker, or over a combination of the speaker and the current monitoring unit, such as a zero Volts potential difference.

5. The audio circuitry as claimed in claim 1, wherein the speaker driver is an H-bridge speaker driver.

6. The audio circuitry as claimed in claim 1, wherein the transfer function further models at least one of the speaker driver and the current monitoring unit, or both of the speaker driver and the current monitoring unit.

7. The audio circuitry as claimed in claim 1, wherein:

when the external sound is incident on the speaker whilst the speaker driver drives the speaker based on the non-emit speaker signal, the monitor signal comprises a microphone component resulting from the external sound; and the converter is defined such that, when the external sound is incident on the speaker whilst the speaker driver drives the speaker based on the non-emit speaker signal, it equalises and/or isolates the microphone component when converting the monitor signal into the microphone signal.

8. The audio circuitry as claimed in claim 1, wherein the microphone signal generator is configured to determine or update the transfer function or parameters of the transfer function based on the monitor signal and an emit speaker signal when the speaker driver drives the speaker based on the emit speaker signal which drives the speaker so that it emits a corresponding sound signal.

9. The audio circuitry as claimed in claim 1, wherein the microphone signal generator is configured to determine or update the transfer function or parameters of the transfer function based on the monitor signal or the microphone signal.

10. The audio circuitry as claimed in claim 9, wherein the microphone signal generator is configured to redefine the converter as the transfer function or parameters of the transfer function change.

11. The audio circuitry as claimed in claim 1, wherein:

the non-emit speaker signal is indicative of or related to or proportional to a voltage signal applied to the speaker; and/or the monitor signal is related to or proportional to the speaker current flowing through the speaker.

12. The audio circuitry as claimed in claim 1, comprising the speaker.

13. The audio circuitry as claimed in claim 1, comprising a speaker-signal generator operable to generate said non-emit speaker signal and/or a microphone-signal analyser operable to analyse the microphone signal.

14. An audio processing system, comprising:

the audio circuitry as claimed in claim 1; and a processor configured to process the microphone signal.

15. The audio processing system as claimed in claim 14, wherein the processor is configured to transition from a low-power state to a higher-power state based on the microphone signal.

16. The audio processing system as claimed in claim 14, wherein the processor is configured to compare the microphone signal to at least one environment signature, and to analyse an environment in which the speaker was or is being operated based on the comparison.

17. A host device, comprising the audio circuitry as claimed in claim 1.

18. Audio circuitry, comprising:

a speaker driver configured to maintain a DC potential difference over a speaker such as a zero Volts potential difference;

a current monitoring unit operable to monitor a speaker current flowing through the speaker and generate a monitor signal indicative of that current; and a microphone signal generator operable, when external sound is incident on the speaker and the speaker driver is maintaining said DC potential difference over the speaker, to generate a microphone signal representative of the external sound based on the monitor signal;

wherein the microphone signal generator comprises a converter configured to convert the monitor signal into the microphone signal based on the DC potential difference, the converter defined at least in part by a transfer function modelling at least the speaker.

* * * * *